United States Patent [19]

Kozacka

[11] 4,215,331

[45] Jul. 29, 1980

[54] PRESSURE CONTACT BETWEEN FERRULES AND FUSIBLE ELEMENT OF ELECTRIC FUSES

[75] Inventor: Frederick J. Kozacka, South Hampton, N.H.

[73] Assignee: Gould Inc., Rolling Meadows, Ill.

[21] Appl. No.: 10,164

[22] Filed: Feb. 7, 1979

[51] Int. Cl.[2] ..... H01H 85/16

[52] U.S. Cl. ..... 335/252; 335/248

[58] Field of Search ..... 337/252, 251, 248, 253, 337/254

[56] References Cited

U.S. PATENT DOCUMENTS

| | | | |
|---|---|---|---|
| 1,716,884 | 6/1929 | Goss | 337/248 |
| 3,691,500 | 9/1972 | Kozacka | 337/252 |
| 4,104,604 | 8/1978 | George | 337/248 |

*Primary Examiner*—Harold Broome

*Attorney, Agent, or Firm*—Erwin Salzer

[57] ABSTRACT

A solderless pressure contact between a cap or ferrule of a fuse and the end of a fusible element that has been bent around the rim of the casing of the fuse from the space inside the casing to the outer surface thereof. A normal ferrule is used, i.e. a ferrule having a planar end surface rather than one having an end surface projecting into the casing of the fuse. The side wall, or lateral wall, of the ferrule is provided with a tab being hingedly supported at the axially inner end thereof by the lateral wall of the ferrule. The aforementioned tab slants from its point of support by the lateral all of the ferrule, or from the axially inner end thereof, axially outwardly and radially inwardly into firm engagement with the end of the fusible element on the outer surface of the casing. This pressure contact requires the use of casings which are electically deformable according to Hooks law, or have a memory, i.e. tend to assume their original shape after having been deformed. The aforementioned single tab formed out of the lateral wall of a ferrule may be sectionalized into two sections. The tab, or its sections, engage the end of the fusible element located on the outer surface of the casing substantially linearly, thus producing an electric contact having a high contact pressure and a small contact resistance.

12 Claims, 9 Drawing Figures

PRESSURE CONTACT BETWEEN FERRULES AND FUSIBLE ELEMENT OF ELECTRIC FUSES

BACKGROUND OF THE INVENTION

This invention relates to an improvement of the subject-matter disclosed in the patent application of Philip C. Jacobs, Jr. filed Sept. 25, 1978, Ser. No. 945,542 for SOLDERLESS FUSE TERMINAL. The invention disclosed in that application is predicated on the properties of fuse casings of certain synthetic resins, more particularly fuse casings as described in U.S. Pat. No. 3,979,709 to Daniel P. Healey, Jr., Sept. 7, 1976 for ELECTRIC FUSE HAVING A MULTIPLY CASING OF SYNTHETIC-RESIN-GLASS CLOTH LAMINATE. Speaking more generally, the present invention is applicable to casings of synthetic resins which can be significantly deformed on account of their elastic properties, or on account of their memory, i.e. the tendency to assume, after deformation thereof, the shape and configuration they originally had. The subject-matter of the above patent application of P. C. Jacobs, Jr. is limited to the same kinds of casing materials.

A fuse as disclosed by Jacobs includes a tubular deformable casing of a synthetic resin having a rim and a fusible element inside said casing bent over said rim and having a portion engaging the outer surface of said casing. A fuse as disclosed by Jacobs further includes a ferrule mounted on said casing and having a radially inwardly directed indentation in registry with said portion of said fusible element on the outer surface of said casing. The aforementioned indentation engages and deforms the portion of the fusible element on the outer surface of said casing, exerting such a pressure against said portion of said fusible element outside said casing to establish an electrically conductive solderless pressure joint between the portion of the fusible element outside of the casing and the indentation in the ferrule.

As explained in the above patent application of Jacobs, best results can be achieved only if there is a metallic back-up for the indentation in the ferrule. Such a back-up is provided by recessing the end surface of the ferrule into the casing or, in other words, by providing the ferrule with an annular portion situated axially outwardly of the rim of the casing, and with a circular portion, or re-entrant portion, situated inside of the casing.

Such special ferrules are more expensive to manufacture than standard ferrules having end surfaces situated in one single plane.

In many instances such special ferrules cannot be applied since they mean a reduction of the internal volume of the fuse that is available for accommodating the fusible element and the pulverulent arc-extinguishing filler.

Another disadvantage of the design proposed by Jacobs resides in the fact that it calls for a reduction of the active length of the fusible element equal to the depth of the cavity formed by each of two ferrules.

There is, therefore, an urgent need to provide a fuse having all the advantages of Jacobs, but none of its disadvantages.

The present invention complies with these requirements.

SUMMARY OF THE INVENTION

Fuses according to this invention include ferrules having end surfaces that are situated in their entirety axially outwardly from the rims of the casing and do not re-enter into the casing. In fuses according to this invention a pair of tabs is formed by the metal of the lateral wall of each of the ferrules. Each of the pair of tabs is hingedly supported on the axially inner end thereof by one of the pair of ferrules and slants from said end axially outwardly and radially inwardly into firm engagement with one of the ends of the fusible element bent over the rims of the casing to the outer surface thereof.

DESCRIPTION OF PREFERRED EMBODIMENT

Figure 1:
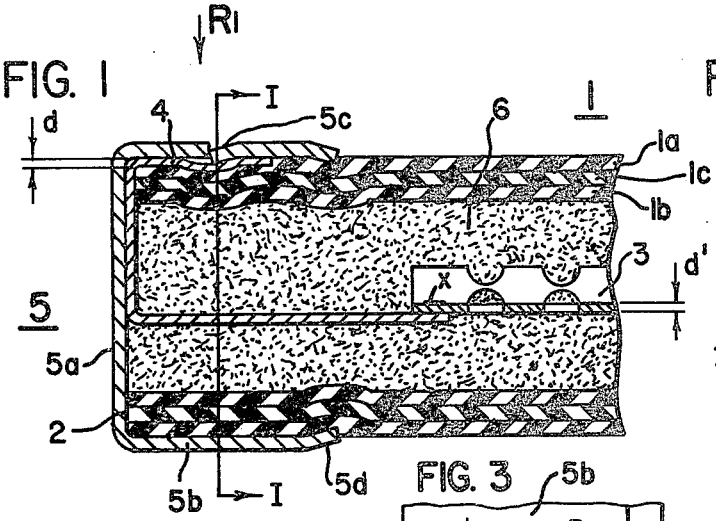
FIG. 1 is a longitudinal section of one end of a fuse embodying this invention and shows the preferred embodiment thereof.

In the drawings but one end of fuses according to this invention has been shown since both its ends are generally identical. This is apparent from U.S. Pat. Nos. 3,143,615, Aug. 4, 1964 for SPRINGLESS TIME-LAG FUSES FOR MOTOR CIRCUITS; 3,261,952, July 19, 1966 for TIME-LAG FUSE WITH RIBBON FUSE LINK HAVING TWO SYSTEMS OF BENDS, and 3,319,028, May 9, 1967 for SPRINGLESS TIME-LAG FUSE FOR MOTOR CIRCUITS, all of which are to Frederick J. Kozacka.

Figure 2:
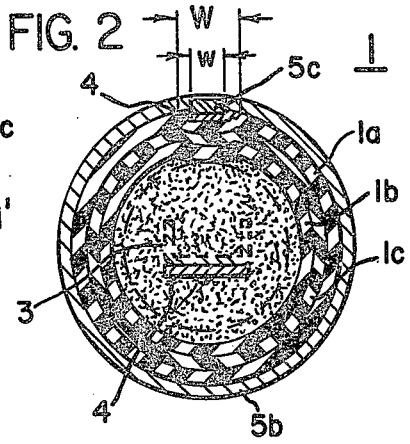
FIG. 2 is a section along I—I of FIG. 1.
Figure 3:
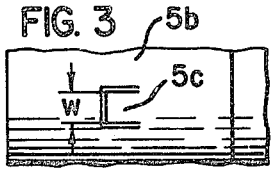
FIG. 3 is view of a portion of the structure of FIG. 1 seen in the direction of the arrow $R_1$ of FIG. 1.

The fuse according to FIGS. 1–3 has a multiply casing 1 which is deformable and includes a synthetic resin. The casing may be deformable on account of its elastic properties, its memory, or both. Casings as described in the above referred-to-patent to Daniel P. Healey, Jr. are preferred for carrying the present invention into effect, but this invention is not limited to such casings as long as the casings are of a synthetic resin, or a glass fiber laminate of a synthetic resin, which allows the casing to be sufficiently deformed. The drawings indicate a casing 1 including an outermost layer 1*a* of woven glass cloth, an innermost layer 1*b* of woven glass cloth and one or more intermediate layers 1*c* of glass fiber mat having randomly oriented fibers. The three layers 1*a*, 1*b*, 1*c* are laminated together by a polyester resin. Such casings are described in greater detail in the above referred to patent to Healey to which reference may be had as to casings suitable for carrying the present invention into effect. Reference numeral 2 has been applied to indicate one of the rims of casing 1. A pulverulent arc-quenching filler 6 such as, e.g. quartz sand, is filled into casing 1. Reference numeral 3 has been applied to indicate a U-shaped fusible element that has a plurality of perforations defining points of reduced cross-sectional area. Fusible element 3 is embedded in arc-quenching filler 6. Fusible element 3 has ends 4 around rim 2 from the inside of casing 1 to the outside thereof. A ferrule 5 is mounted on the left end of casing 1. Ferrule 5 has a radially inwardly directed indentation clamping the end 4 of fusible element 3 that is on the outside of casing 1 against casing 1. This indentation will be described below in detail.

The end surface 5*a* of ferrule 5 is situated in its entirety axially outwardly of rim 2 of casing 1, i.e. the end surface 5*a* of ferrule 5 does not form a recess or cavity projecting into casing 1, nor does it re-enter from rim 2 into casing 1 as described in the above referred-to-patent application of Jacobs.

A tab 5*c* is formed by the metal of the lateral wall 5*b* of ferrule 5. Tab 5*c* is hingedly supported on the axially inner end thereof by ferrule 5, i.e. the end thereof which is relatively close to the center of casing 1. The axially outer end of tab 5*c*, i.e. the end thereof which is relatively remote from the center of casing 1, slants from the axially inner end thereof axially outwardly and radially inwardly into firm engagement with the end 4 of fusible element 3 situated on the outside of casing 1. The pressure of metal tab 5*c* is normally so large, or may be made so large, that the end 4 of fusible element 3 is permanently deformed. Manual removal of cap 5 from casing 1 is impossible. If cap or ferrule 5 is removed from casing 1 by a power tool involving a screw-thread, the pressure of tab 5*c* upon end 4 of fusible element 3 is so large as to form a deep groove in end 4 incident to removal of ferrule 5 by such means.

It will be noted that fusible element proper 3 and its end 4 may be two separate parts which may be made either of the same metal, or of different metals. If parts 3 and 4 are separate, they must be conductively connected to each other by a spot weld indicated at x. This I disclaim to be my invention. My invention consists in the above described combination of a tab 5*c* of a ferrule 5 with an end 4 of fusible element proper 3. The end 4 on the outer surface of casing 1 may have a predetermined thickness d that exceeds the thickness d' of the perforated portion of the fusible element proper. Or, in other terms, $d>d'$. It will be understood that this is a desirable but not a necessary feature of my invention. If the ends 4 of fusible element proper 3 are of increased thickness, this increases the pressure with which said ends 4 are engaged by tab 5*c* portions thereof pushed into the outer surface of casing 1. To put it in other words, this increases the contact pressure between parts 5*c* and 4, and also increases the pressure with which end 4 is pushed by tab 5*c* into the outer surface of casing 1.

It has been found desirable to make the width w of tab 5*c* less than the width W of ends 4, as clearly indicated in FIG. 2. This has the tendency to increase the contact pressure between parts 4 and 5*c*.

The right end of the lateral wall 5*b* of ferrule 5 is knurled into casing 1. This has the tendency of improving the contact between parts 4 and 5*c* because it resists any axial force tending to withdraw ferrule 5 from casing 1. The knurl may be of the kind described in U.S. Pat. No. 4,104,604, Aug. 1, 1978 to Delbert L. George for NARROWLY KNURLED END CAP FOR AN ELECTRIC FUSE which kind of knurl is particularly suitable for fuses having casings made according to the teaching of the aforementioned U.S. Pat. No. 3,979,709 to Healey.

The structures shown in FIGS. 4 to 9 are the same as those shown in FIGS. 1–3 with the exception of the tab formed by the lateral wall, or walls, of the ferrule, or ferrules, respectively. The same reference characters have been applied in all figures to indicate like parts. Hence FIGS. 4 to 9 require description only inasmuch as these figures show structures that differ from those shown in FIGS. 1–3.

Figure 4:
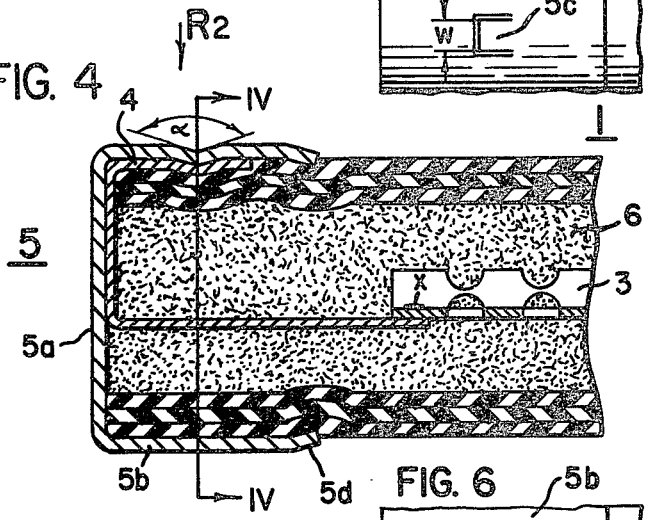
FIG. 4 is a longitudinal section of one end of another fuse embodying this invention.
Figure 5:
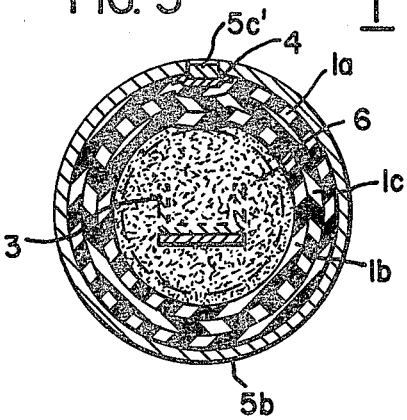
FIG. 5 is a section along IV—IV of FIG. 4.
Figure 6:
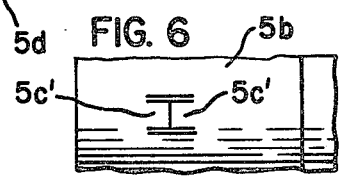
FIG. 6 is a view of a portion of the structure of FIG. 4 seen in the direction of the arrow $R_2$ of FIG. 4.
Figure 7:
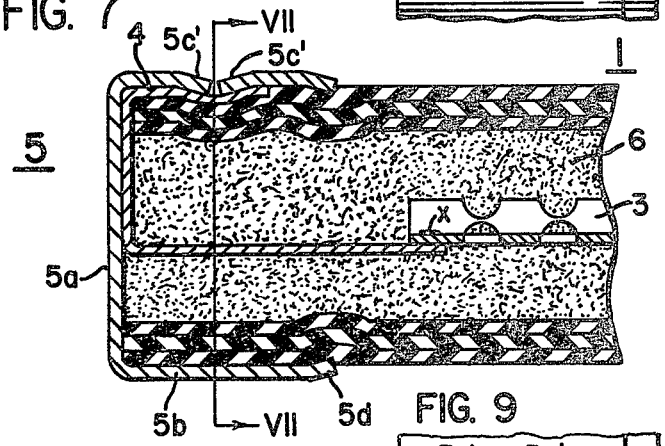
FIG. 7 is a longitudinal section of one end of another fuse embodying this invention.
Figure 8:
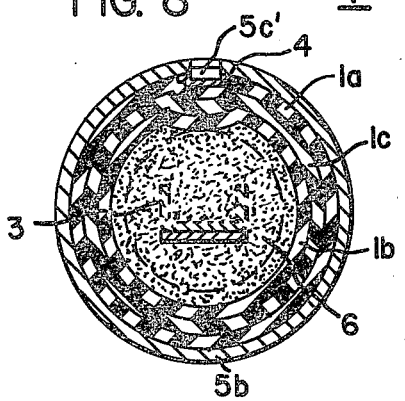
FIG. 8 is a section along VII—VII of FIG. 7.
Figure 9:
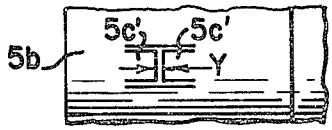
FIG. 9 is a view of a portion of the structure of FIG. 7 seen in the direction of the arrow $R_3$ of FIG. 7.

The tabs formed by the lateral walls 5*b* of ferrules 5 include two sections rather than but one section as shown in FIGS. 1 and 3. As shown in FIGS. 4 to 6 each tab includes two tab sections 5*c*'. Both sections are hingedly supported on opposite ends thereof by the lateral wall 5*b* of ferrule 5. The planes of tab sections 5*c*' enclose an obtuse angle $\alpha$. Sections 5*c*' are formed by an H-shaped incision in the lateral wall 5*b* of ferrule 5. The sections 5*c*' of each pair of tabs intersect along a line 5*e* in engagement under pressure with end 4 of fusible element 3 on the outer surface of casing 1.

In FIGS. 4 to 6 both tabs 5*c*' engage the ends of fusible element 4 at one and the same point. According to FIGS. 7 to 9 the points of engagement of tabs 5*c*' and fusible element 4 are separated by a gap y.

In all of the embodiments shown a gap is formed between the tab 5*c* and tabs 5*c*', respectively, and the lateral wall 5*b* of ferrule 5. That gap is channel-shaped (FIGS. 1–3), or in the shape of two separate channels (FIGS. 7–9), or in the shape of two abutting channels whose web portions are not spaced from each other. What is common to all embodiments of the invention, and of critical importance, is that tabs 5*c* and 5*c*' engage the fusible element 4 on the outer surface of casing 1 substantially linearly because a linear pressure contact has a very small contact resistance. This is per se well known in the art, and has been shown in detail in the publications of R. Holm to which reference may be had in regard to the factors controlling resistance between two engaging contact members.

I claim as my invention:

1. In an electric fuse comprising a deformable tubular casing of a synthetic resin having a pair of rims on the ends thereof, a pulverulent arc-quenching filler inside said casing, a fusible element embedded in said arc-quenching filler and having ends bent around said pair of rims from the inside of said casing to the outer surface thereof, a pair of ferrules mounted on said casing over said ends of said fusible element on the outer surface of said casing, and said ends of said fusible element on the outer surface of said casing and said pair of ferrules being conductively connected by solderless means, each of said pair of ferrules having a radially inwardly directed indentation engaging under pressure said ends of said fusible element on the outer surface of said casing and clamping said ends of said fusible element on the outer surface of said casing against said casing, wherein the novel feature consists in that the end surfaces of said pair of ferrules are situated in their entirety axially outwardly from said pair of rims of said casing and do not re-enter into said casing, and in that a pair of tabs is formed by the metal of the lateral wall of each of said pair of ferrules, each of said pair of tabs being hingedly supported on the axially inner end thereof by said lateral wall of said pair of ferrules and slanting from said axially inner end axially outwardly and radially inwardly into firm engagement with one of said ends of said fusible element on the outer surface of said casing.

2. An electric fuse as specified in claim 1 wherein said engagement of said ends of said fusible element on the outer surface of said casing by said pair of tabs results in the formation of permanent recesses in said ends of said fusible element.

3. An electric fuse as specified in claim 1 wherein the thickness of said ends of said fusible element on the outer surface of said casing is larger than the thickness of said fusible element in the center of said casing to increase the contact pressure between said pair of tabs and said ends of said fusible element on the outer surface of said casing.

4. An electric fuse as specified in claim 1 wherein the width of each of said pair of tabs is less than the width of said ends of said fusible element on the outer surface of said casing.

5. An electric fuse as specified in claim 1 wherein said casing comprises an outermost layer of woven glass-cloth, an innermost layer of woven glass-cloth, at least one intermediate layer of glass fiber mat having randomly oriented fibers, and wherein the constituent layers of said casing are laminated by a polyester resin.

6. An electric fuse as specified in claim 1 wherein each of said pair of tabs is hingedly supported on opposite ends thereof by the lateral wall of one of said pair of ferrules, and wherein each of said pair of tabs includes two sections the planes of which enclose obtuse angles.

7. An electric fuse as specified in claim 5 wherein said sections of each of said pair of tabs intersect along a line which is in engagement under pressure with one of said ends of said fusible elements on the outer surface of said casing.

8. An electric fuse as specified in claim 5 wherein said sections of each of said pair of tabs engage under pressure at spaced points said ends of said fusible element on the outer surface of said casing.

9. An electric fuse comprising a deformable tubular casing of a synthetic resin having a pair of rims on the ends thereof, a pulverulent arc-quenching filler inside said casing, a fusible element embedded in said arc-quenching filler and having ends bent around said pair of rims from the inside of said casing to the outer surface thereof, a pair of ferrules mounted on said casing over said ends of said fusible element on the outer surface of said casing, and said ends of said fusible element on the outer surface of said casing and said pair of ferrules being conductively connected by solderless means, each of said pair of ferrules having a radially inwardly directed indentation engaging under pressure said ends of said fusible element on the outer surface of said casing and clamping said ends of said fusible element on the outer surface of said casing against said casing, wherein the novel feature consists in that the circular end surface of each of said pair of ferrules is situated in a single plane axially outwardly from said pair of rims, and in that each of the lateral walls of said pair of ferrules forms a pair of tabs each hingedly supported on one end thereof by one of said lateral walls and separated by a channel-shaped gap from each of said lateral walls, each of said pair of tabs slanting on the end thereof opposite to said end supported by one of said lateral walls into substantially linear engagement with one of said ends of said fusible element on the outer surface of said casing resulting in sufficient contact pressure between said pair of tabs and said ends of said fusible element on the outer surface of said casing in the absence of metallic back-up means for said casing at the ends thereof engaged by said ends of said fusible element on the outer surface of said casing.

10. An electric fuse as specified in claim 9 wherein portions of said fusible element on the outer surface of said casing are thicker than the fusible portion of said fusible element inside said casing to maximize the contact pressure exerted by said pair of tabs upon said ends of said fusible element on the outer surface of said casing.

11. A fuse as specified in claim 8 wherein said casing comprises a plurality of layers laminated by a polyester resin, said plurality of layers including an outermost layer of woven glass fibers, an innermost layer of woven glass fibers, and at least one intermediate layer of fiber glass mat having randomly oriented fibers.

12. An electric fuse comprising a deformable tubular casing including an outermost layer of woven glass cloth, an innermost layer of woven glass cloth, and at least one intermediate layer of glass fiber mat having randomly oriented fibers, said layers being bonded together into a laminate by a polyester resin, a rim formed at one of the ends of said casing, a pulverulent arc-quenching filler inside said casing, a fusible element embedded in said arc-quenching filler and having an end bent around said rim from the inside of said casing to the outer surface thereof, a ferrule mounted on said casing and clamping said end of said fusible element on said surface of said casing against said casing, said ferrule having a planar end surface on the axially outer end thereof and being knurled into said casing at the axially inner end thereof, wherein the novel feature consists in that a channel-shaped slot in the lateral wall of said ferrule forms a tab hingedly supported by said lateral wall of said ferrule at the end thereof adjacent the knurled end of said ferrule slanting from said end in the direction of said planar end surface of said ferrule radially inwardly into firm substantially linear engagement with the end of said fusible element on said outer surface of said casing.

* * * * *